US008434627B2

(12) United States Patent
Sporer

(10) Patent No.: US 8,434,627 B2
(45) Date of Patent: May 7, 2013

(54) METHOD AND DEVICE FOR PROCESSING VALUABLE DOCUMENTS

(75) Inventor: Gerhard Sporer, Pocking (DE)

(73) Assignee: Giesecke & Devrient GmbH, Munich (DE)

( * ) Notice: Subject to any disclaimer, the term of this patent is extended or adjusted under 35 U.S.C. 154(b) by 318 days.

(21) Appl. No.: 12/919,266

(22) PCT Filed: Feb. 27, 2009

(86) PCT No.: PCT/EP2009/001436

§ 371 (c)(1),
(2), (4) Date: Aug. 25, 2010

(87) PCT Pub. No.: WO2009/106355

PCT Pub. Date: Sep. 3, 2009

(65) Prior Publication Data

US 2011/0005982 A1 Jan. 13, 2011

(30) Foreign Application Priority Data

Feb. 28, 2008 (DE) ..... 10 2008 011 664

(51) Int. Cl.
*B07C 5/00* (2006.01)

(52) U.S. Cl.
USPC ..... 209/534; 194/206; 194/207; 902/9

(58) Field of Classification Search ..... 209/534; 902/9, 12, 13; 194/206, 207
See application file for complete search history.

(56) References Cited

U.S. PATENT DOCUMENTS

| | | | | |
|---|---|---|---|---|
| 3,976,198 | A | 8/1976 | Carnes, Jr. | |
| 4,236,639 | A * | 12/1980 | Boettge et al. | 209/534 |
| 4,722,443 | A | 2/1988 | Maruyama | |
| 5,617,956 | A * | 4/1997 | Werner et al. | 209/534 |
| 6,601,687 | B1 * | 8/2003 | Jenrick et al. | 194/206 |
| 6,640,156 | B1 | 10/2003 | Brooks et al. | |
| 6,771,180 | B2 * | 8/2004 | Mizuta et al. | 340/674 |

FOREIGN PATENT DOCUMENTS

| | | | |
|---|---|---|---|
| DE | 102004013903 | A1 | 10/2005 |
| GB | 2000487 | A | 1/1979 |
| WO | 00/57367 | A | 9/2000 |
| WO | 2005/096233 | A | 10/2005 |

OTHER PUBLICATIONS

Search report of German Patent Office regarding German Patent Application No. 10 2008 011 664.5, Dec. 17, 2008.
International Search Report in PCT/EP2009/001436, Jul. 23, 2009.

* cited by examiner

*Primary Examiner* — Joseph C Rodriguez
(74) *Attorney, Agent, or Firm* — Bacon & Thomas, PLLC

(57) ABSTRACT

A method and apparatus for processing value documents where the value documents are checked according to certain criteria and sorted in accordance with the results of the check. Those value documents upon whose check an error has occurred are transported to a deposit device having several deposit sections. The faulty value documents of different accounting units are thereby deposited on different deposit sections of the deposit device. For post-processing of the faulty value documents, they are removed from the deposit device by an operator according to the first in, first out principle.

15 Claims, 1 Drawing Sheet

METHOD AND DEVICE FOR PROCESSING VALUABLE DOCUMENTS

FIELD OF INVENTION

The present invention relates to a method and apparatus for processing value documents, in particular bank notes, checks, coupons, tickets, etc.

BACKGROUND

From the prior art there are known apparatuses for processing bank notes which have an input pocket for receiving bank notes, a singling device, a transport system, a checking device arranged along the transport system, and several output pockets. The bank notes are checked according to certain criteria and sorted into different output pockets in accordance with the results of the check. All bank notes upon whose check an error has occurred are deposited in a certain output pocket. An error can occur for example when a bank note has not been recognized, e.g. because it is unknown or on account of a multiple removal upon singling of the bank notes. Immediately after the end of bank-note processing of an accounting unit, the stack of faulty bank notes is post-processed, in particular counted, by the operator of the apparatus in order for the number of processed bank notes of the particular accounting unit to be properly registered. The processing of bank notes of a new accounting unit is only started when the faulty bank notes of the preceding accounting unit have been removed from the apparatus. A disadvantage of this method is that the operator of the apparatus must manually remove the faulty bank notes from the apparatus immediately after the end of processing in order for the operation of the apparatus not to be interrupted too long between two accounting units.

Furthermore, apparatuses are known that process bank notes at very high speed, so that the faulty bank notes cannot be post-processed immediately after processing, but for time reasons must be stored temporarily. In so doing, all bank notes checked by the apparatus and evaluated as faulty by the checking device are transported to a single temporary store, e.g. to a film accumulator, in which the faulty bank notes of many different accounting units are stored successively. After a multiplicity of accounting units have been processed, the temporary store containing the faulty bank notes of all accounting units is removed from the apparatus by the operator and inserted into a post-processing apparatus. For post-processing, the post-processing apparatus fetches the faulty bank notes out of the temporary store in reverse order, i.e.

the faulty bank notes stored last are removed from the temporary store first and post-processed. With said temporary store, however, it is not possible to carry out the post-processing of the faulty bank notes immediately after the automatic processing of the bank notes by the apparatus, because the faulty bank notes are stored in the temporary store so as to be inaccessible to the operator.

SUMMARY

Hence, it is an object of the present invention to state an apparatus and method for processing value documents permitting the post-processing of faulty value documents to be carried out immediately after their automatic processing, and the value documents to be post-processed in temporally flexible fashion.

This object is achieved by the features of the independent claims. In claims dependent thereon there are stated advantageous embodiments and developments of the invention.

In the method according to the invention, value documents are automatically processed, in particular singled, transported, checked and deposited, using an apparatus for value-document processing. Value documents belonging to different accounting units are, in so doing, inserted into the apparatus successively and automatically processed thereby. At the beginning of the method, value documents inserted into an input pocket of the apparatus are singled by a singling device of the apparatus and transported through the apparatus using a transport system. At the same time, a check of the value documents is carried out using a checking device which checks the value documents for the fulfillment of check criteria, whereby e.g. the authenticity of the value documents is checked. The checking device can moreover also check the state of the value documents and/or determine the type of value document, e.g. the currency and denomination thereof in the case of bank notes. The value documents are transported through the apparatus in dependence on the results of the check and sorted according to certain check criteria. The valid value documents are usually transported into one or several different output pockets, while the faulty value documents are transported to a deposit device having several deposit sections and deposited on the deposit device. The faulty value documents of different accounting units are, in so doing, deposited in different deposit sections of the deposit device, in particular by a stacking device of the apparatus.

Faulty value documents are understood to be value documents upon whose check certain check criteria are not fulfilled and which are hence evaluated as faulty by the checking device upon checking. The faulty value documents are rejected by the apparatus and returned to an operator of the apparatus for manual post-processing. Faulty value documents may be non-recognized value documents which were not recognized by the checking device of the apparatus upon checking, or value documents that were evaluated as forgeries or as suspect upon checking. Non-recognized value documents are for example value documents that are unknown or that are transported through the apparatus in superimposed arrangement on account of the simultaneous singling of several value documents, or value documents that are not recognized by the checking device of the apparatus on account of excessive transport deviations, e.g. skew, of the value document. The non-recognized value documents can be returned to the operator of the apparatus together or separately from the suspect value documents and the value documents recognized as forgeries. If the non-recognized value documents are returned separately, the operator can confine himself to the non-recognized value documents upon manual post-processing. The suspect value documents or forgeries can, but do not have to, be post-processed manually. All other value documents fulfilling the check criteria are evaluated as valid by the checking device. Hence, valid value documents are value documents that were recognized and evaluated as authentic upon checking.

The apparatus first automatically processes value documents of a first accounting unit and subsequently value documents of a second accounting unit which were inserted into the input pocket of the apparatus after those of the first accounting unit. An accounting unit can be formed for example by one or by several bank-note packs. After the value documents of the first accounting unit have been automatically processed, the deposit sections of the deposit device can be moved in such a way that the faulty value documents of the second accounting unit can be deposited on a different deposit section of the deposit device from those of the first accounting unit. In particular, the faulty value documents of the first accounting unit are deposited in a first deposit section and thereafter the faulty value documents of the second accounting unit are deposited in a second deposit section. The faulty value documents of the different accounting units, which are deposited in the different deposit sections, are manually removed section by section and post-processed.

Optionally there can be provided one or several monitoring devices which monitor the stacks of faulty value documents deposited on the different deposit sections for their position and/or for their extension. The monitoring devices can be configured as light barriers which monitor the edges of the deposit sections, in particular the boundaries between the deposit sections. It is also possible to use as a monitoring device a camera which captures images of the deposit sections with the faulty value documents deposited thereon and, using a corresponding image processing, checks whether the faulty value documents are deposited properly. Moreover, monitoring devices can also be used for ascertaining whether faulty value documents are transported outside the accordingly provided area or get caught before reaching the deposit device during the process of depositing or stack formation. If the monitoring device ascertains an irregularity, a corresponding message can be output on the apparatus and the operation of the apparatus interrupted automatically or manually.

Moreover, the apparatus can have a movable auxiliary device whose motion is synchronized with the transport of the faulty value documents in order to support the proper depositing of the faulty value documents on their deposit sections. For example, the arrival of a faulty value document can be ascertained using a monitoring device, e.g. a light barrier, and the auxiliary device be moved, in synchronism with the depositing of the faulty value document, for supporting the depositing. There can be employed as an auxiliary device a movable hold-down device provided specially for this purpose. Alternatively, there can also be employed as an auxiliary device the stripping element of a stacking device, which deposits the faulty value documents on the deposit device. For supporting the depositing, the stripping element can be moved toward the deposit section in synchronism with the faulty value document, starting out from the stripping position.

Furthermore, the deposit sections can have devices for retaining the deposited faulty value documents on the particular deposit section, in particular devices that press on the deposited faulty value documents from above until they are removed manually. For this purpose there can be employed e.g. for each deposit section a spring arm which presses permanently on the value documents. This prevents the deposited faulty value documents from slipping due to the motion of the deposit sections or due to external influences. In this manner it is possible to ensure both the order of the individual faulty value documents and their assignment to the particular deposit section or to the particular accounting unit.

After the automatic processing of the value documents of the first accounting unit, the faulty value documents of the first accounting unit are removed from the first deposit section of the deposit device, in particular by an operator of the apparatus. The automatic processing of the value documents of the second accounting unit can already be started before removal of the faulty value documents of the first accounting unit. The faulty value documents of the first accounting unit can be removed from the deposit device before, during or also only after the depositing of the faulty value documents of the second accounting unit, at will. Preferably, a post-processing of the faulty value documents of the first accounting unit is started immediately after the removal of the faulty value documents of the first accounting unit, e.g. during the automatic processing of the value documents of the second accounting unit.

The faulty value documents of the different accounting units are removed from the deposit device according to the first in, first out principle. That is, that stack of faulty value documents that was first formed or deposited on the deposit device is also removed from the deposit device first and preferably also post-processed first. The faulty value documents of the first accounting unit are thus removed from the deposit device earlier than the faulty value documents of the second accounting unit. In particular, the at least one stack of faulty value documents of the first accounting unit is removed from the apparatus before the at least one stack of faulty value documents of the second accounting unit. The deposit device has the function of a first in, first out store for the faulty value documents of different accounting units.

After the automatic processing of the faulty value documents of one accounting unit is finished, in particular after the depositing of the faulty value documents of the accounting unit on a deposit section is finished, the deposit sections are moved. Moving is effected in such a way that the faulty value documents of the different accounting units can be deposited on different deposit sections. Preferably, the deposit sections are moved immediately after the depositing of the last faulty value document of each (e.g. the first) accounting unit and before the beginning of the automatic processing of the value documents of the next (e.g. the second) accounting unit. Moving may be a moving further of the deposit sections on the basis of a cyclic motion of the deposit sections, in particular a moving further by approximately the length of one deposit section. The moving of the deposit sections causes exactly one of the deposit sections to be positioned for depositing faulty value documents. Preferably, the moving of the deposit sections causes one or several stacks of faulty value documents of one or several accounting units to be presented for removal, e.g. to the operator. The deposit sections can be moved e.g. at a point in time that is after the end of the depositing of all faulty value documents of the first accounting unit and that is before the beginning of the automatic processing of the value documents of the second accounting unit. Moving can be effected e.g. in a pause between the automatic processing of the value documents of two immediately consecutive accounting units. The motion of the deposit sections is preferably initiated by the apparatus, in particular a control and evaluation device of the apparatus.

In each of the deposit sections, only faulty value documents of a single accounting unit are deposited. If the accounting unit contains exactly one input pack of value documents, the faulty value documents of said input pack are preferably deposited on exactly one of the deposit sections. If the number of faulty value documents of the input pack exceeds the capacity of one deposit section, however, the remaining faulty value documents can be deposited in another deposit section, so that the faulty value documents are divided over several deposit sections. If the accounting unit contains several input packs, it is also possible to deposit per deposit section the faulty value documents of several input packs belonging to the same accounting unit. This is preferably carried out when the number of faulty value documents of the accounting unit is so small that the faulty value documents of several input packs can be accommodated in the same deposit section. Alternatively, the faulty value documents of the different input packs of the same accounting unit can also be deposited in different deposit sections, so that the faulty value documents of said accounting unit are divided over several deposit sections. In the case of division over different deposit sections, the operator removes the faulty value documents deposited on the different deposit sections and belonging to the same accounting unit, and carries out a common post-processing of said faulty value documents.

The apparatus according to the invention which can be employed for carrying out the method according to the invention has a singling device for singling the value documents inserted into the apparatus, a checking device for checking the value documents, a transport system for transporting the value documents in dependence on results of the check, and at least one deposit device. The deposit device has several deposit sections which are configured in each case for receiving several faulty value documents, in particular in each case at least one stack of faulty value documents. Preferably, the deposit device is arranged on the apparatus in such a way that the value documents can be deposited immediately on the deposit device by the apparatus, in particular by a stacking device of the apparatus. In one embodiment, the deposit sections possess at least the size of the largest value documents to be processed, so that the faulty value documents can be deposited horizontally, i.e. with the value-document plane parallel to the surface of the deposit sections. The deposit device can have e.g. a transport band, in particular an endless band, which is subdivided into several deposit sections.

In an alternative embodiment, the faulty value documents are deposited on the deposit sections of the deposit device not horizontally, but standing on their longitudinal edges. The deposit sections can then advantageously be configured shorter in the moving direction of the deposit apparatus than the width of the value documents. For this purpose, the faulty value documents can first be deposited horizontally on a temporary deposit means under the stacking device and subsequently be transported in stacks from the temporary deposit means to the deposit device according to the invention. The temporary deposit means can be formed for example by a roller or a short endless transport band which moves a stack of rejected value documents out of the area under the stacking device for delivery to the deposit device and deposits it in a deposit section of the deposit device with the help of gravity. The value documents deposited horizontally on the temporary store can e.g. be turned around their longitudinal axis under the influence of gravity to an approximately vertical position and dropped onto one of the deposit sections.

The deposit device is arranged permanently on the apparatus, i.e. it is not removed from the apparatus during the usual operation of the apparatus, in particular during the automatic processing of the value documents. In particular, the deposit device remains arranged on the apparatus both during the automatic processing of the value documents of an accounting unit and during the post-processing of the faulty value documents of said accounting unit. For example, the deposit device can be fastened to the apparatus and/or be part of the apparatus. The deposit device is preferably configured and arranged on the apparatus in such a way that during an operation of the apparatus, in particular during the automatic processing of value documents by the apparatus, at least one of the deposit sections can be accessed from outside the apparatus in order to remove faulty value documents from the deposit device. In a preferred embodiment, the deposit device is arranged immediately adjacent to an operator interface of the apparatus and/or immediately adjacent to a further deposit means on which the faulty value documents can be put by the operator for post-processing. For example, the deposit device is arranged on the apparatus in such a way that an operator of the apparatus can access both the operator interface and the deposit device from his usual working position. Preferably, the operator can from this working position both remove the faulty value documents from the deposit device and post-process them, e.g. on the further deposit means.

BRIEF DESCRIPTION OF THE DRAWINGS

The invention will hereinafter be explained more closely with reference to figures.

There are shown.

DETAILED DESCRIPTION OF VARIOUS EMBODIMENTS OF THE DISCLOSURE

Figure 1:
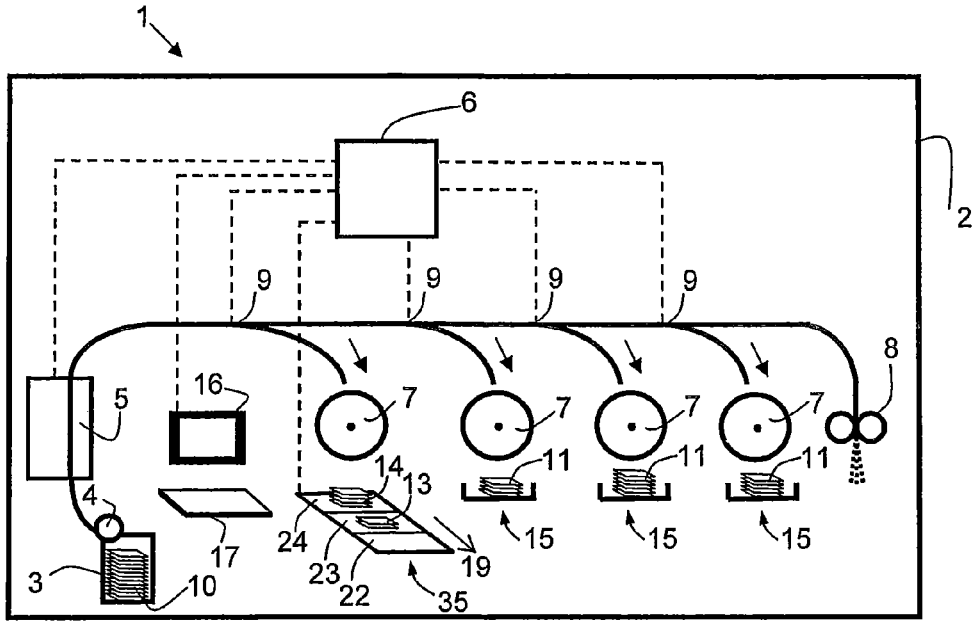
FIG. 1 a schematic representation of a sorting apparatus for value documents, FIG. 2 an embodiment of a deposit device according to the invention.

FIG. 1 schematically shows an example of a sorting apparatus 1 for bank notes. It has a housing 2 having integrated thereinto an input pocket 3 which is freely accessible from outside. An operator of the sorting apparatus can insert into the input pocket 3 a pack of bank notes 10 to be processed which belong for example to an accounting unit B. Instead of input pockets 3 for manual inputting of bank notes, means can also be present for fastening and automatically emptying bank-note cassettes. The bank notes 10 input to the input pocket 3 are removed from the stack by a singler 4. The singled bank notes 10 are transported through the sorting apparatus 1 using a transport system, whereby they pass through a sensor device 5 which checks the bank notes 10. The sensor device 5 can have different sensor modules in order to check e.g. magnetic, optical, acoustic or electrical properties of the bank notes and, through evaluation of the measuring values, to obtain information about the authenticity and/or the currency and/or the denomination and/or the state of the checked bank notes. In dependence on the results of the sensor device 5 and predefined sorting criteria, a control and evaluation device 6 initiates the sorting of the bank notes 10 through control of the gate elements 9. In this manner the bank notes 10 are transported to the various output pockets 15 or to the deposit device 35 before which there is in each case arranged a spiral pocket stacker 7 which deposits the bank notes 11, 13, 14 on the particular stack. The control and evaluation device 6 controls the various components of the sorting apparatus 1 and/or receives information therefrom (dashed connecting lines). In the sorting apparatus 1 there can optionally also be present a unit 8 for canceling or destroying those bank notes that are not to be put back into circulation on account of the poor state recognized by the sensor device 5.

The deposit device 35 of the sorting apparatus 1 has several deposit sections 22, 23, 24 on which a stack of faulty bank notes 13, 14 can be deposited in each case. The deposit sections 22, 23, 24 of the deposit device 35 can be moved in the direction of the arrow 19, so that any one of the deposit sections 22, 23, 24 can be arranged under the associated spiral pocket stacker 7. The sorting apparatus 1 moreover has an operator interface 16, e.g. a display with a keyboard, or a touchscreen, by which an operator can operate the sorting apparatus 1, obtains information and can input data. Furthermore, there is arranged on the sorting apparatus 1 a table surface 17 which can be mounted immediately below the operator interface 16 and on which the operator can carry out a manual post-processing of the faulty bank notes 13, 14. The table surface 17, the deposit device 35 and the input pocket 3 are arranged on the sorting apparatus 1 in such a way that they are easy to reach for an operator at the operator interface 16 during the operation of the sorting apparatus 1.

For sorting the bank notes, an input pack of bank notes 10 is inserted into the input pocket 3 of the sorting apparatus 1. The inserted bank notes 10 belong for example to an accounting unit B which is formed by a deposit of a certain bank-note deliverer, e.g. a commercial bank or a department store. The bank notes 10 of the accounting unit B are sorted by the sorting apparatus 1. Those bank notes of the accounting unit B that fulfill previously defined check criteria are judged as valid by the control and evaluation device 6 and transported to the output pockets 15, whereby at the same time a sorting of the valid bank notes 11 according to certain sorting criteria can be carried out. The valid bank notes 11 are those bank notes of the accounting unit B that could be identified and were found to be authentic by the control and evaluation device 6. The faulty bank notes 14 of the accounting unit B are rejected by the control and evaluation device 6 and, hence, transported to the deposit device 35 which receives the faulty bank notes 14 in the deposit section 24. The faulty bank notes 14 are for example all bank notes of the accounting unit B that were not recognized upon checking. In FIG. 1 there is moreover depicted a stack of faulty bank notes 13 which are deposited on the deposit section 23 and which belong to an accounting unit A which was processed by the sorting apparatus 1 before the bank notes of the accounting unit B. The faulty bank notes 13 are manually post-processed e.g. during the automatic processing of the bank notes 10.

To permit the end of the processing of the inserted bank notes 10 to be ascertained, both the presence of input bank notes 10 in the input pocket 3 and the transport of the bank notes 10 within the sorting apparatus 1 can be monitored using light barriers. After the processing of all inserted bank notes 10 is finished, the deposit device can be prompted by the control and evaluation device 6 to move the deposit sections further in the direction of the arrow 19 by one deposit section. The deposit section 24 on which the faulty bank notes 14 of the accounting unit B are located is thereby moved out of the area under the spiral pocket stacker 7, whereby the faulty bank notes 14 are presented to the operator for removal. At the same time or immediately thereafter, a subsequent deposit section is arranged under the spiral pocket stacker 7, which can receive further faulty bank notes.

After the sorting apparatus 1 has finished processing the inserted bank notes 10 and has moved the deposit section 24 with the faulty bank notes 14 of the accounting unit B out of the sorting apparatus 1, the operator removes the faulty bank notes 14 and carries out a manual processing of the faulty bank notes 14. The faulty bank notes 14 are thereby counted and their number, optionally also their denominations, input by the operator at the operator interface 16. The input data of the faulty and manually post-processed bank notes 14 are at the same time assigned to the accounting unit B. Even before the manual removal of the faulty bank notes 14, the sorting apparatus 1 can begin with the automatic processing of further bank notes which are to be processed by the sorting apparatus 1 after the bank notes 10 of the accounting unit B. The faulty bank notes of the accounting unit C are deposited on the subsequent deposit section of the deposit device 35, which has previously been arranged under the spiral pocket stacker 7.

Figure 2:
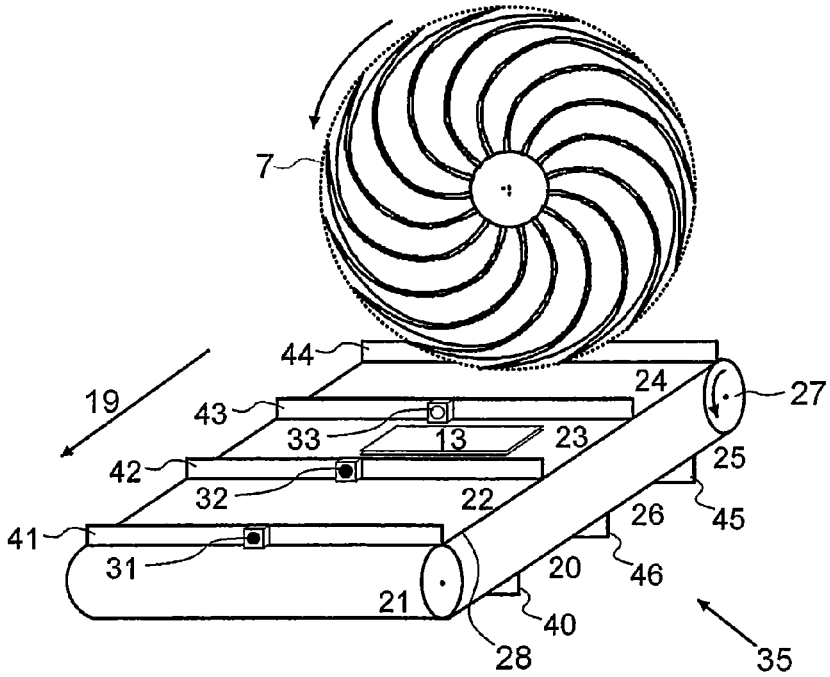

In a special embodiment example, the deposit device 35 has several cyclically consecutive deposit sections 20-26 which are formed by successive sections of a transport band 28, cf. FIG. 2. At the time depicted in FIG. 2, the automatic processing of the bank notes 10 of the accounting unit B has already been started, but no faulty bank notes 14 of the accounting unit B have yet been deposited in the deposit section 24. The deposit sections 20-26 are separated from each other by separating elements 40-46 and configured in each case for receiving exactly one stack of bank notes. The transport band 28 can be moved in the direction of the arrow 19, e.g. using a motor which drives the roller 27. The motion of the deposit sections 20-26 of the deposit device 35 is initiated by the control and evaluation device 6, e.g. in each case immediately after the sorting apparatus 1 has finished the automatic processing of one of the accounting units A, B, C. In this manner the faulty bank notes of the individual accounting units A, B, C can be presented to the operator of the sorting apparatus 1 successively for removal and manual post-processing.

The deposit sections 20-26 can in each case have an identification indicator (not shown) and/or a progress indicator 31-33. The identification indicator can contain a designation of the particular deposit section 20-26, e.g. a number. On the progress indicator 30-36 there can be indicated which of the deposit sections 20-26 is active at the moment, i.e. which one or ones of the deposit sections 20-26 contain the faulty bank notes that belong to the accounting unit being processed and that are to be post-processed next. In the shown example, this is the deposit section 23 with the progress indicator 33 which contains the faulty bank notes 13 of the accounting unit A. The deposit device 35 can also have a further indicator, e.g. a display (not shown), which shows information about the faulty bank notes deposited in the particular deposit sections, e.g. the number of faulty bank notes proposed by the sorting apparatus 1, and/or the rejection reasons. The further indicator can also be formed by one or several LEDs which indicate, e.g. by glowing or flashing, whether a suspect bank note or a forged bank note has been deposited in one of the deposit sections 20-26. Alternatively, there can also be arranged on each of the deposit sections 20-26 one or several LEDs which indicate, e.g. by glowing or flashing, whether suspect or forged bank notes have been deposited in the particular deposit section. The removal of the faulty bank notes 13, 14 from the deposit sections 20-26 can be monitored using light barriers. If e.g. the faulty bank notes 13 are not removed from the deposit device 35 in time, the sorting apparatus 1 can automatically interrupt its operation and output a corresponding message at the operator interface 16.

The end of an accounting unit can be recognized by the sorting apparatus 1 automatically by the reading of machine-readable information about the particular accounting unit A, B, C, for example of a bar code applied to the straps of the input bank-note packs or to separation cards inserted between the accounting units A, B, C. As soon as the sorting apparatus 1 has ascertained the beginning of a new accounting unit B, and the preceding accounting unit A has been fully processed, the control and evaluation device 6 obtains a corresponding signal. Said device subsequently waits until the last faulty bank note 13 of the accounting unit A has been deposited on the deposit section 23. As soon as this has happened, the control and evaluation device 6 sends a control signal to the deposit device 35, thereby prompting the deposit sections 20-26 to be moved further.

In a further special embodiment, the sorting apparatus 1 has several of the deposit devices according to the invention. For example, there can be provided in the sorting apparatus 1 a first deposit device 45 to which the non-recognized bank notes are transported, and a second deposit device 55 to which the forged and suspect bank notes are transported (not shown). The deposit devices 45 and 55 can be constructed just like the deposit device 35.

The invention claimed is:

1. A method for processing value documents comprising:

singling value documents belonging to different accounting units including at least a first and second accounting unit, checking the value documents, transporting the value documents in dependence on results of the check, including transporting faulty value documents to a deposit device having several deposit sections, depositing the faulty value documents of the different accounting units on different deposit sections of the deposit device, removing the faulty value documents from the deposit device by removing the faulty value documents of the different accounting units from the deposit device according to a first in, first out principle.

2. The method according to claim 1, wherein value documents of the first accounting unit are automatically processed and thereafter value documents of the second accounting unit are automatically processed.

3. The method according to claim 2, wherein the faulty value documents of the first accounting unit are removed from the deposit device earlier than the faulty value documents of the second accounting unit.

4. The method according to claim 1, wherein, immediately after the removal of the faulty value documents of an accounting unit, a post-processing of the faulty value documents of the accounting unit is begun.

5. The method according to claim 1, wherein the deposit sections are moved in such a way that depositing the faulty value documents of the different accounting units on different deposit sections of the deposit device is enabled.

6. The method according to claim 2, wherein the deposit sections are moved in such a way that depositing the faulty value documents of the different accounting units on different deposit sections of the deposit device is enabled, and wherein the deposit sections are moved at a point in time that is after the end of the depositing of the faulty value documents of the first accounting unit and before the beginning of the automatic processing of the value documents of the second accounting unit.

7. The method according to claim 1, wherein the faulty value documents deposited in one or in several deposit sections are presented for removal by moving the deposit sections.

8. An apparatus for processing value documents comprising:

a singling device for singling value documents, a checking device for checking the value documents, a transport system for transporting the value documents in dependence on results of the checking, a deposit device having several deposit sections which are each configured to receive several faulty value documents, wherein the deposit device functions as a first in, first out store for faulty value documents of different accounting units.

9. The apparatus according to claim 8, wherein the deposit device is arranged permanently on the apparatus.

10. The apparatus according to claim 8, wherein the deposit device is arranged permanently on the apparatus, and wherein each of the deposit sections of the deposit device is configured to receive at least one stack of faulty value documents.

11. The apparatus according to claim 8, wherein the deposit device is arranged permanently on the apparatus and the deposit sections are movable out of the apparatus in such a way that during an operation of the apparatus at least one of the deposit sections is accessible from outside the apparatus.

12. The apparatus according to claim 8, wherein the deposit sections are movable through which movement exactly one of the deposit sections is positioned for depositing faulty value documents from the transport system.

13. The apparatus according to claim 8, wherein the apparatus has a stacking device configured to deposit the faulty value documents of the different accounting units on the different deposit sections of the deposit device, and wherein the different deposit sections of the deposit device are movable to receive the faulty value documents from the stacking device.

14. The apparatus according to claim 8, wherein the deposit device has a transport band having several deposit sections.

15. The apparatus according to claim 8, wherein the apparatus has a movable auxiliary device whose motion is synchronized with the transport of the faulty value documents in order to support the proper depositing of the faulty value documents on their deposit sections.

* * * * *